US009310770B2

(12) United States Patent
Verardo et al.

(10) Patent No.: US 9,310,770 B2
(45) Date of Patent: Apr. 12, 2016

(54) GEAR SYSTEM FOR A TIMEPIECE

(75) Inventors: Marco Verardo, Les Bois (CH); Thierry Conus, Lengnau (CH); Jean-Philippe Thiebaud, Cudrefin (CH); Jean-Bernard Peters, La Chaux-de-Fonds (CH)

(73) Assignee: Nivarox-FAR S.A., Le Locle (CH)

( * ) Notice: Subject to any disclaimer, the term of this patent is extended or adjusted under 35 U.S.C. 154(b) by 806 days.

(21) Appl. No.: 13/059,216

(22) PCT Filed: Jul. 23, 2009

(86) PCT No.: PCT/EP2009/059477

§ 371 (c)(1),
(2), (4) Date: Feb. 15, 2011

(87) PCT Pub. No.: WO2010/018051

PCT Pub. Date: Feb. 18, 2010

(65) Prior Publication Data

US 2011/0141860 A1 Jun. 16, 2011

(30) Foreign Application Priority Data

Aug. 15, 2008 (EP) ..... 08162475

(51) Int. Cl.
*G04B 13/02* (2006.01)
*G04D 3/00* (2006.01)

(52) U.S. Cl.
CPC ..... *G04B 13/026* (2013.01); *G04D 3/0069* (2013.01)

(58) Field of Classification Search
CPC ..... G04B 13/02; G04B 33/10; G04B 11/003; G04B 13/026; G04D 3/0069
USPC ..... 368/322–326; 29/231, 896.31
See application file for complete search history.

(56) References Cited

U.S. PATENT DOCUMENTS

| | | | | |
|---|---|---|---|---|
| 217,291 | A * | 7/1879 | Lambert | 368/322 |
| 7,287,901 | B1 * | 10/2007 | Helfer et al. | 368/147 |
| 7,505,373 | B2 * | 3/2009 | Paratte et al. | 368/157 |
| 2009/0081476 | A1 | 3/2009 | Saucy | |

FOREIGN PATENT DOCUMENTS

| | | |
|---|---|---|
| CH | 694 465 | 1/2005 |
| EP | 0 732 635 | 9/1996 |
| EP | 1 705 533 | 9/2006 |
| EP | 1 835 050 | 9/2007 |

(Continued)

OTHER PUBLICATIONS cavity—dictionary.com :: Jun. 11, 2014.*

(Continued)

*Primary Examiner* — Sean Kayes
(74) *Attorney, Agent, or Firm* — Oblon, McClelland, Maier & Neustadt, L.L.P

(57) ABSTRACT

The invention relates to a system including a pinion (5) and a toothed wheel (7) coaxially mounted relative to a pivoting arbor (3). According to the invention, the gear system (1) includes a securing device (21) between the pinion and the wheel so as to prevent any relative movement of one with respect to the other. The invention also relates to methods of manufacturing the toothed wheel (7) and the final assembly of the gear system (1). The invention concerns the field of timepieces.

10 Claims, 2 Drawing Sheets

(56) References Cited

FOREIGN PATENT DOCUMENTS

| | | |
|---|---|---|
| JP | 59-135385 | 8/1984 |
| JP | 61-253488 | 11/1986 |

OTHER PUBLICATIONS

International Search Report issued in corresponding application PCT/EP2009/059477, completed Nov. 13, 2009 and mailed Nov. 20, 2009.

* cited by examiner

GEAR SYSTEM FOR A TIMEPIECE

This is a National Phase Application in the United States of International Patent Application PCT/EP2009/059477 filed Jul. 23, 2009, which claims priority on European Patent Application No. 08162475.1 of Aug. 15, 2008. The entire disclosures of the above patent applications are hereby incorporated by reference.

FIELD OF THE INVENTION

The invention relates to a composite gear system, for example silicon-metal, for a timepiece, and, more specifically, a system of this type that includes a securing device that can prevent shearing stress.

BACKGROUND OF THE INVENTION

In order to prevent shearing stress, it is known within the field of horology to use arbours that have a polygonal, i.e., non circular section so as to drive in rotation a part whose arbour hole has a shape that matches the polygonal section. However, this configuration, particularly in the case of a gear train, induces asymmetry in the arbour, which is detrimental to the isochronism of the timepiece movement and requires the other gear trains, secured to the same arbour, to adopt arbour holes of the same shape.

Moreover, in the case of a composite timepiece member, i.e. one that includes two types of material, such as a gear system of the toothed wheel-pinion type, it is difficult to attach the member to a polygonal arbour without breaking it, if one of the materials includes a very restricted plastic range area, like crystalline silicon, crystalline alumina or crystalline silica.

SUMMARY OF THE INVENTION

It is an object of the present invention to overcome all or part of the aforementioned drawbacks by proposing a gear system that includes a securing device, which can prevent shearing stress, yet can be adapted to a cylindrical arbour of circular section.

The invention therefore relates to a gear system comprising a pinion and a toothed wheel coaxially mounted relative to a pivoting arbour, characterized in that it includes a securing device between the pinion and the wheel to prevent any relative movement of one in relation to the other.

According to other advantageous features of the invention:

- the securing device includes an impression or pattern cavity whose shape at least partially matches the section of the pinion, which is made on the hub of the wheel to secure the pinion and wheel in rotation;
- the impression is made in a part of the thickness of the hub so as to block any relative movement by partially enveloping the pinion;
- the arbour is approximately cylindrical with a circular section;
- the arbour and the pinion are made from a metallic material;
- the pinion is integral with the arbour;
- the toothed wheel is made from a micro-machinable material;
- the micro-machinable material is chosen from among the group including crystalline silicon, crystalline alumina and crystalline silica;

- the securing device further includes an adherent or adhesive material mounted between the wheel and the pinion so as to improve the securing force of the device.

The invention also relates to a timepiece, characterized in that it includes a gear system in accordance with one of the preceding variants.

The invention relates finally to a method of manufacturing a timepiece member in micro-machinable material with several levels, which includes the following steps:

a) providing a substrate made of micro-machinable material;

b) structuring a mask that includes a first pattern on the surface of the substrate;

characterized in that it includes the following steps:

c) structuring a second mask on the surface of the substrate and the first mask, the second mask including a second pattern that is smaller than the first pattern of the first mask;

d) performing an anisotropic etch so as to etch the second pattern over a first thickness of the substrate;

e) removing the second mask;

f) performing a second anisotropic etch so as to continue the etch along the second pattern and to start the etch along the first pattern over a second thickness of the substrate;

g) removing the first mask;

h) releasing the timepiece member from the substrate.

According to other advantageous features of the invention:

- the second pattern is etched through the entire thickness of the substrate;
- the second pattern has the shape of a toothed wheel whose hub includes an arbour hole;
- the first pattern has the shape of a toothed ring and is partially etched in the thickness of the substrate;
- the first mask is made from silicon oxide and the second mask is made from a photosensitive resin;
- several members are manufactured on the same substrate.

Thus, in accordance with a first non-limiting illustrative embodiment of the present invention, a gear system (1) is provided that includes a pinion (5) and a toothed wheel (7), coaxially mounted relative to a pivoting arbour (3), and a securing device (21) between the pinion and the wheel so as to prevent any relative movement of one with respect to the other, characterized in that the securing device (21) includes a pattern cavity (23) whose shape at least partially matches the section of the pinion, which is made on the hub (13) of the wheel so as to secure the pinion and wheel in rotation. In accordance with a second non-limiting illustrative embodiment of the present invention, the first non-limiting embodiment is modified so that the pattern cavity (23) is made in a part of the thickness ($e_2$) of the hub so as to block any relative movement by partially enveloping the pinion (5). In accordance with a third non-limiting illustrative embodiment of the present invention, the first and second non-limiting embodiments are modified so that the arbour (3) is approximately cylindrical with a circular section.

In accordance with a fourth non-limiting illustrative embodiment of the present invention, the first, second, and third non-limiting embodiments are further modified so that the arbour (3) and the pinion (5) are made from a metallic material. In accordance with a fifth non-limiting illustrative embodiment of the present invention, the first, second, third and fourth non-limiting embodiments are further modified so that the pinion (5) is integral with the arbour (3). In accordance with a sixth non-limiting illustrative embodiment of the present invention, the first, second, third, fourth and fifth non-limiting embodiments are further modified so that the toothed wheel (7) is made from a micro-machinable material. In accordance with a seventh non-limiting illustrative embodiment of the present invention, the first, second, third, fourth, fifth and sixth non-limiting embodiments are further modified so that the micro-machinable material is chosen from among the group including crystalline silicon, crystalline alumina and crystalline silica. In accordance with an eighth non-limiting illustrative embodiment of the present invention, the first, second, third, fourth, fifth, sixth and seventh non-limiting embodiments are further modified so that the securing device (21) further includes an adhesive material mounted between the wheel (7) and the pinion (5) so as to improve the securing force of the device. In accordance with a ninth non-limiting illustrative embodiment of the present invention, a timepiece is provided, and is characterized in that it includes a gear system (1) according to any one of the first, second, third, fourth, fifth, sixth, seventh and eighth non-limiting embodiments of the invention.

In accordance with a tenth non-limiting illustrative embodiment of the present invention, a method of manufacturing a member (7) of a gear system in micro-machinable material on several levels is provided, wherein the method includes the following steps: (a) providing a substrate (31) made of micro-machinable material; (b) structuring a mask (33) including a first pattern (32) on the surface of the substrate; characterized in that it includes the following steps: (c) structuring a second mask (35) on the surface of the substrate and the first mask (33), wherein the second mask includes a second pattern (34) that is smaller than the first pattern (32) of the first mask; (d) performing an anisotropic etch so as to etch the second pattern (34) over a first thickness ($e_1$) of the substrate (31); (e) removing the second mask (35); (f) performing a second anisotropic etch so as to continue the etch along the second pattern (34) and to start the etch along the first pattern (32) over a second thickness ($e_2$) of the substrate (31); (g) removing the first mask (33); and (h) releasing the timepiece member (7) from the substrate (31). In accordance with an eleventh non-limiting illustrative embodiment of the present invention, the tenth non-limiting embodiment is modified so that the second pattern (34) is etched in the entire thickness ($e_T$) of the substrate (31). In accordance with a twelfth non-limiting illustrative embodiment of the present invention, the eleventh non-limiting embodiment is further modified so that the second pattern (34) has the shape of a toothed wheel (7) whose hub (13) includes an arbour hole (15).

In accordance with a thirteenth non-limiting illustrative embodiment of the present invention, the tenth, eleventh and twelfth non-limiting embodiments are further modified so that the first pattern (32) having the shape of a toothed ring (23) is partially etched in the thickness ($e_2$) of substrate (31). In accordance with a fourteenth non-limiting illustrative embodiment of the present invention, the tenth, eleventh, twelfth and thirteenth non-limiting embodiments are further modified so that the first mask (33) is made from silicon oxide and the second mask (35) is made from a photosensitive resin. In accordance with a fifteenth non-limiting illustrative embodiment of the present invention, the tenth, eleventh, twelfth and thirteenth non-limiting embodiments are further modified so that the first (33) and second (35) masks are made from silicon oxide. In accordance with a sixteenth non-limiting illustrative embodiment of the present invention, the tenth, eleventh, twelfth, thirteenth, fourteenth and fifteenth non-limiting embodiments are further modified so that several members (7) are manufactured on the same substrate (31).

BRIEF DESCRIPTION OF THE DRAWINGS

Other peculiarities and advantages will appear clearly from the following description, given by way of non-limiting illustration, with reference to the annexed drawings, in which.

DETAILED DESCRIPTION OF THE INVENTION

Figure 7:
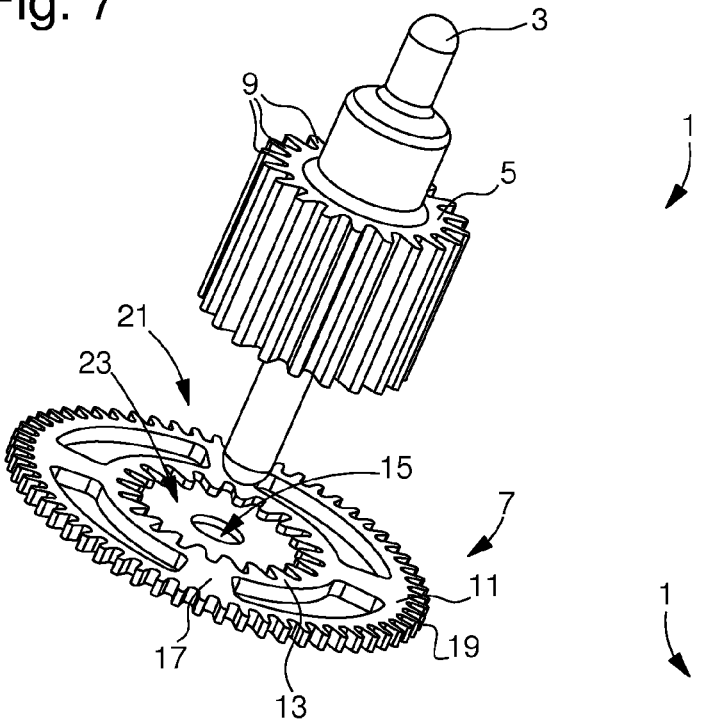
FIGS. 7 to 9 are diagrams of successive steps in the final assembly of a gear system according to the invention.
Figure 8:
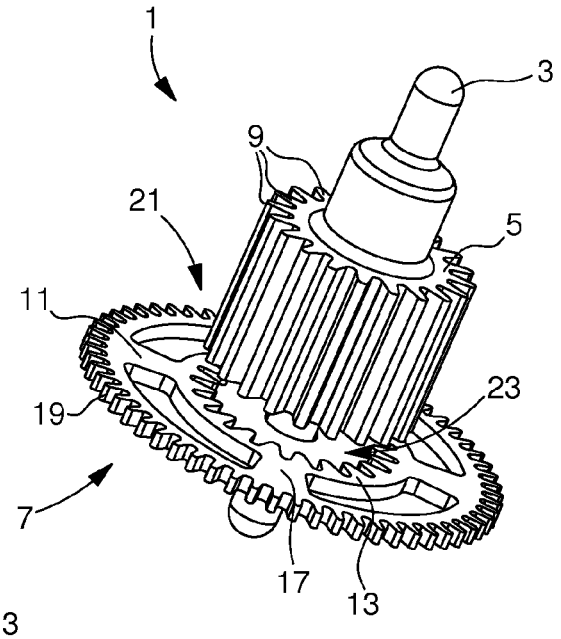
Figure 9:
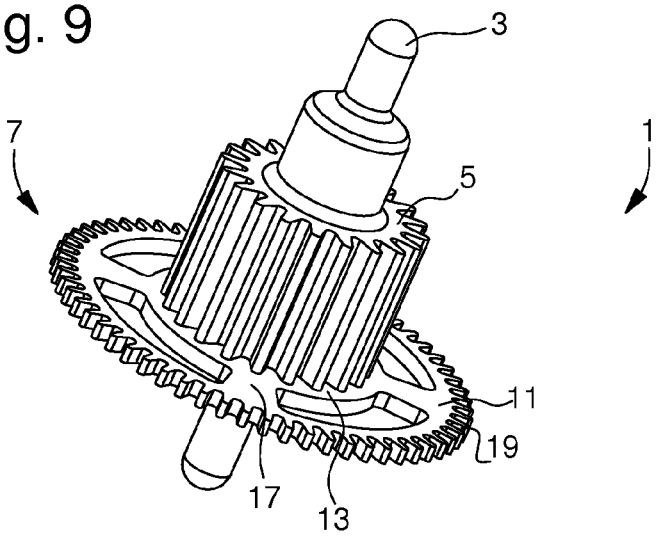

As illustrated in FIGS. 7 to 9, the invention relates to a gear system generally designated 1. It includes an arbour 3, a pinion 5 and a toothed wheel 7. In the example illustrated in FIGS. 7 to 9, pinion 5 and wheel 7 intended to be mounted coaxially on the same arbour 3. This type of gear system 1 may, for example, be applied to an escape wheel or transmission wheel set. Of course, the invention may be applied to other timepiece members or non-horological members.

As illustrated in FIGS. 7 to 9, arbour 3 is approximately cylindrical with a circular section, i.e. perfectly symmetrical for mounting between two bearings (not shown) in a conventional manner, as explained above.

Pinion 5 has a main body of cylindrical shape, whose inner diameter section approximately matches the external diameter of arbour 3. Pinion 5 includes wings 9 that extend radially from the main body to cooperate with another toothed member (not shown). In the example illustrated in FIGS. 7 to 9, pinion 5 has twenty or so wings 9, however, depending upon the application of gear system 1, the number may be higher or lower.

Wheel 7 includes a felloe 11, a hub 13 pierced with a polygonal or cylindrical arbour hole 15 and four arms 17 connecting the hub and the felloe. As illustrated in FIGS. 7 to 9, fellow 11 has a peripheral toothing 19 that extends radially from the felloe so as to cooperate with another toothed member (not shown). Of course, the number of arms 17 that connect felloe 11 and hub 13 may be smaller or greater depending upon the application.

According to the invention, hub 13 preferably includes a securing device 21, for preventing any relative movement of wheel 7 with respect to pinion 5 so as to reduce shearing stress. According to the invention, securing device 21 mainly includes a pattern cavity 23 formed on hub 13 for cooperating with the low part of pinion 5 by partially covering the same.

Preferably, as illustrated in FIGS. 7 to 9, pattern cavity 23 is hollowed out in hub 13. Moreover, pattern cavity 23 includes a shape that at least matches partially the section of the low part of pinion 5, i.e. a ring including a toothing into which at least one part of wings 9 and the main body of pinion 5 are fitted over one part of the height of the pinion. It is thus clear that, when the low part of pinion 5 is slid into pattern cavity 23, the assembly limits any angular displacements between pinion 5 and wheel 7, consequently preventing any shearing stress.

In the example illustrated in FIGS. 7 to 9, pattern cavity 23 has a shape that exactly matches the section of pinion 5. However, it is clear that pattern cavity 23 could include fewer teeth than there are wings 9 of pinion 5 and still prevent any shearing stress. This pattern cavity could for example consist of a toothing including twice as fewer teeth as pinion 5 has wings 9.

Preferably, gear system 1 is of the composite type, i.e. it is formed of at least two types of material. Thus, one of the members is preferably formed of a micro-machinable material and the others of metallic materials. According to the invention, a micro-machinable material is used in order to benefit from manufacturing precision of less than a micron. This material may comprise crystalline silicon, crystalline alumina or crystalline silica. The other members are preferably made of metallic materials, when they do not need to have more precise dimensions than is possible with the metallic materials.

According to the invention, wheel 7 is preferably formed from a micro-machinable material whereas arbour 3 and pinion 5 are made from a metallic material, such as, for example, steel or brass. This configuration may be useful, in particular, for an application of the escape wheel type so as to obtain an impulse toothing 19 and also a pattern cavity 23 that are very precise. Indeed, as can be seen in FIG. 7, wheel 7 has an intermediate etch depth for pattern cavity 23 and a total etch for the rest of the member.

According to a variant of the invention, securing device 21 further includes an adhesive material mounted between impression 23 and pinion 5, so as to improve the securing force of the device. This material may be, for example, a solder, or an adhesive. Indeed, a connection using an adhesive material generally performs well in traction but poorly in shearing. It is thus clear that, because of the configuration of securing device 21, the securing force therefore benefits from the traction advantages of the adhesive material and the shearing advantages of the partial covering by pattern cavity 23.

The adhesive material may be, for example, placed between the bottom of pattern cavity 23 and the bottom of pinion 5. The adhesive material may equally well be placed between the periphery of wings 9 and the toothing of pattern cavity 23. This latter configuration is particularly advantageous when the shape of pattern cavity 23 does not match the section of pinion 5 exactly, as explained above.

The method of manufacturing the member in micro-machinable material and with several levels will now be explained with reference to FIGS. 1 to 6. As explained hereinbefore, member made of micro-machinable material is preferably a toothed wheel 7. In order to simplify the Figures and focus on the explanation of the etch at several levels, only one part of hub 13 is shown in cross-section. Of course, in addition to arbour hole 15, which is etched throughout, other cavities are made throughout so as to delimit hub 13, arms 17, felloe 11 and toothing 19.

Figure 1:
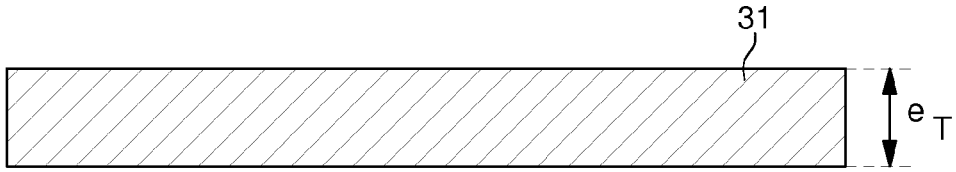
FIGS. 1 to 6 are diagrams of successive steps in the manufacture of a timepiece member according to the invention.

In a first step, as illustrated in FIG. 1, one provides a substrate 31 in micro-machinable material such as, preferably, crystalline silicon, crystalline alumina or crystalline silica. This step may include a mechanical and/or chemical backlapping phase for substrate 31 so as to adapt the thickness $e_T$ of substrate 31 to that of the final member, i.e. wheel 7.

Figure 2:
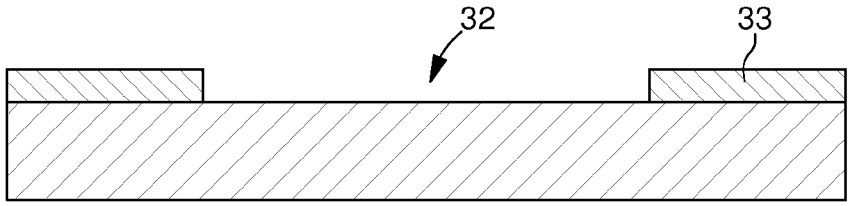

In a second step, a first protective mask 33 is structured on the top of substrate 31. This step may be achieved for example by selective oxidation at the surface of substrate 31 in order to grow silicon oxide to form the mask to a determined height. As seen in FIG. 2, mask 33 shows the pattern 32 of pattern cavity 23 to be etched on one part $e_2$ of the thickness of substrate 31.

Figure 3:
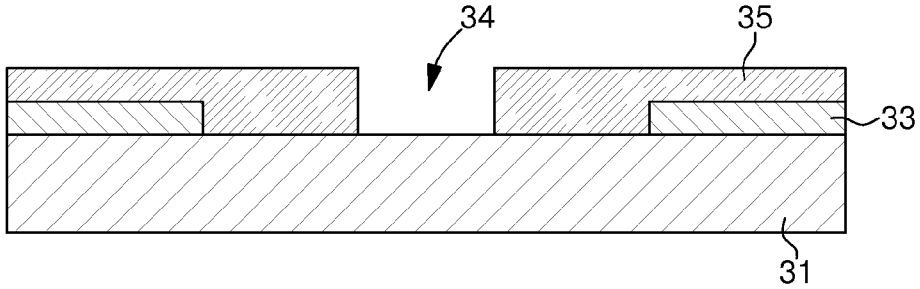

In a third step, a second protective mask 35 is structured overlapping mask 33 made in the second step. This step may be performed by photolithography of a photosensitive resin. Then in a first phase, a photosensitive resin is deposited on substrate 31 and on protective mask 33. Then, in a second phase, the resin is selectively exposed using radiation through a partially opaque mask. Finally, the selectively illuminated photosensitive resin is developed so as to leave only a protective mask 35, as shown in FIG. 3, which shows pattern 34 of arbour hole 15 and the other throughout cavities of wheel 7 to be etched in the thickness of substrate 31.

According to a variant, the second mask 35 can also be made by selective oxidation of the surface of substrate 31 in order to grow silicon oxide to form the mask to a predetermined height.

Figure 4:
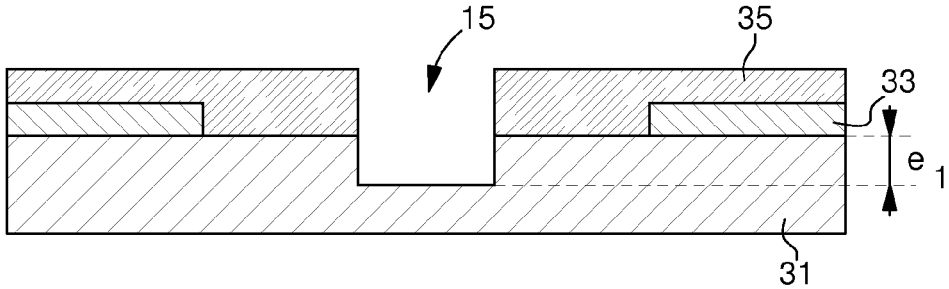

In a fourth step, as shown in FIG. 4, an anisotropic etch is performed on substrate 31 along pattern 34 of the second protective mask 35. The etch may be dry or wet. Preferably, deep reactive ion etching (DRIE) will be used. As explained above, the etch means that both arbour hole 15 and also the other throughout cavities of wheel 7 can start to be etched. As shown in FIG. 4, at the end of the etch, substrate 31 is etched along pattern 34 over one part $e_1$ of its thickness $e_T$.

In a fifth step, the second mask 35 is removed. Depending upon the nature of second mask 35, this may consist respectively in removing the structured resin or etching the silicon oxide layer until pattern 32 is exposed.

Figure 5:
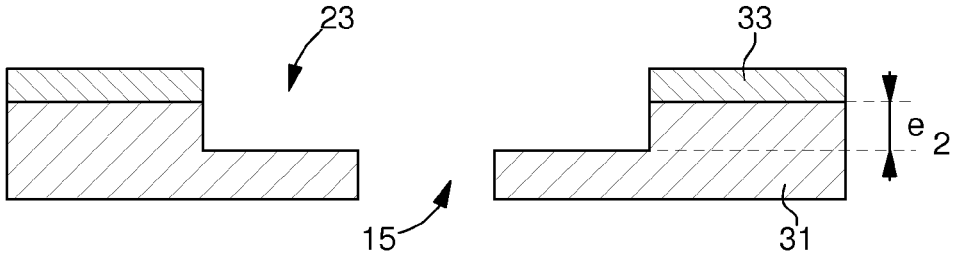
Figure 6:
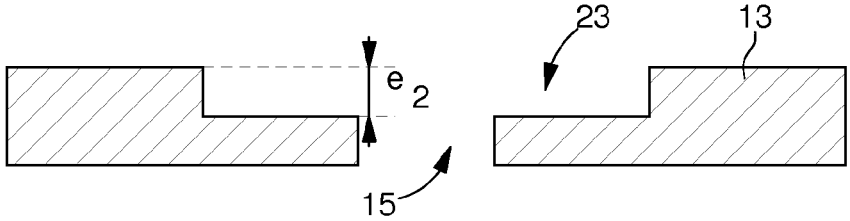

In a sixth step, a second anisotropic etch is performed on substrate 31 along to pattern 32 of the first protective mask 33. The etch may also be dry or wet. In a similar manner to the fourth step, the second etch continues the etch of arbour hole 15, but also of the other throughout holes of wheel 7 and starts the etch of pattern cavity 23. As shown in FIG. 5, at the end of the second etch, substrate 31 is etched over its entire thickness $e_T$ and along pattern 34 and over one part $e_2$ of its thickness along pattern 32.

Preferably according to the invention, the section of pattern 34 of second mask 35 is smaller at hub 13, as shown in FIG. 3 or 4, than that of pattern 32 of first mask 33 This means that pattern 34 can be etched alone, then patterns 34 and 32 can be etched together. In the seventh and final step, the finished wheel 7 is released from substrate 31.

It is clear from reading the manufacturing method for timepiece member 7 that, depending upon the total thickness $e_T$ of substrate 31 and the depth $e_2$ of pattern cavity 23, one can deduce therefrom the minimum etch depth $e_1$ that has to be performed in the fourth step so that arbour hole 15 and the other cavities delimiting hub 11, arms 17, felloe 11 and toothing 19 are etched in the entire thickness of substrate 31. It is also clear that, advantageously, the manufacturing method allows several members 7 to be made on the same substrate 31.

The final assembly method will now be explained with reference to FIGS. 7 to 9. First of all, pinion 5 has to be fixedly mounted on arbour 3. Preferably, according to the invention, in order to simplify the assembly method, but also to limit any sliding between pinion 5 and arbour 3, the first is integral with the second so as to form a single part. Of course, other types of assembly are possible, like, for example, driving in, bonding or soldering.

In a second step, the pinion 5—arbour 3 assembly is mounted on timepiece member 7 made in accordance with the manufacturing method explained above, a toothed wheel in the example, so as to form the composite gear system 1. In a first phase, the pinion 5—arbour 3 assembly is moved towards member 7 so that the low end of arbour 3 is opposite arbour hole 15 of wheel 7 as illustrated in FIG. 7. In a second phase, continuing the movement towards member 7, arbour 3 slides through arbour hole 15 in a push fit manner as illustrated in FIG. 8, until, in a third phase, the bottom of pinion 5 fits into impression 23 hollowed out in hub 13 of wheel 7.

As explained above, according to a variant of the invention, an adhesive material can be used to improve the force securing pinion 5 and wheel 7. In this variant, two additional phases could be added. An intermediate phase between the second and third phases of the final assembly method could consist in depositing the material in the bottom of pattern cavity 23. This material could be a solder and/or an adhesive such as a polymer adhesive. A final phase could then follow the third phase and would activate the adhesive material, for example, by melting the solder and/or polymerising the adhesive.

Two final phases could also be envisaged. The first could consist in depositing the material between the toothings of pattern cavity 23 and the wings 9 of pinion 5. This material could also be a solder and/or an adhesive such as a polymer adhesive. The second final phase would then activate the adhesive material, for example, by melting the solder and/or polymerising the adhesive. This embodiment is particularly advantageous when the shape of pattern cavity 23 does not exactly match the section of pinion 5 as explained above.

As illustrated in FIG. 9, a composite gear system 1 of the toothed wheel and pinion type is thus obtained, which can be integrated in a timepiece and which includes a wheel 7 made of micro-machinable material, whose felloe 11 has a toothing 19 and whose hub 13 is advantageously linked to the arbour 3—pinion 5 assembly by means of securing device 21.

Of course, the present invention is not limited to the illustrated example but may be subject to various variants and alterations, which will appear to those skilled in the art. In particular, pattern cavity 23 may project at least partially from hub 13. Indeed, this would increase the contact zone between arbour 3 and hub 13, which would improve the guiding of wheel 7 relative to arbour 3. The contact zone could even match the total height of wheel 7, and pattern cavity 23 would then project entirely from hub 13 of wheel 7, instead of being at least partially indented.

Thus, the invention relates generally to a gear system for a timepiece, wherein the gear system includes a pinion (5) and a toothed wheel (7) coaxially mounted relative to a pivoting arbour (3). According to the invention, the gear system (1) includes a securing device (21) between the pinion and the wheel so as to prevent any relative movement of one with respect to the other. The invention also relates generally to methods of manufacturing the toothed wheel (7) and the final assembly of the gear system (1). The invention concerns the field of timepieces.

The invention claimed is:

1. A gear system including:

(a) a pinion and a toothed wheel, coaxially mounted relative to a pivoting arbour, wherein the toothed wheel includes a hub pierced with an arbour hole so as to be mounted on the pivoting arbour; and (b) a securing device permitting the pinion to be secured to the wheel so as to prevent any relative movement of one with respect to the other, wherein the securing device is integral with the hub of the toothed wheel and includes a blind pattern cavity surrounding the arbour hole, wherein the inner periphery of the hub and the outer periphery of the pinion correspond so as to define a blind pattern cavity shape which matches a section of the pinion so as to secure the pinion and wheel in rotation, wherein the pinion is fixedly mounted to the pivoting arbour.

2. The gear system according to claim 1, wherein the blind pattern cavity is made in a part of a thickness of the hub so as to block any relative movement by partially enveloping the pinion.

3. The gear system according to claim 1, wherein the pivoting arbour is approximately cylindrical with a circular section.

4. The gear system according to claim 1, wherein the pivoting arbour and the pinion are made from a metallic material.

5. The gear system according to claim 1, wherein the pinion is integral with the pivoting arbour.

6. The gear system according to claim 1, wherein the toothed wheel is made from a micro-machinable material.

7. The gear system according to claim 6, wherein the micro-machinable material is selected from the group consisting of crystalline silicon, crystalline alumina and crystalline silica.

8. The gear system according to claim 1, wherein the securing device further includes an adhesive material mounted between the toothed wheel and the pinion so as to improve a securing force of said securing device.

9. A timepiece, wherein the timepiece includes the gear system according to claim 1.

10. A gear system including:

(a) a pinion and a toothed wheel, coaxially mounted relative to a pivoting arbour, wherein the toothed wheel includes a hub pierced with an arbour hole so as to be mounted on the pivoting arbour; and (b) a securing device permitting the pinion to be secured to the wheel so as to prevent any relative movement of one with respect to the other, wherein the securing device is integral with the hub of the toothed wheel and includes a blind pattern cavity surrounding the arbour hole, wherein the hub comprises a plurality of cavity shapes which correspond with an integer multiple number of corresponding pinion shapes located on the periphery edge of the pinion so as to define a blind pattern cavity shape which matches a section of the pinion so as to secure the pinion and wheel in rotation, wherein the pinion is fixedly mounted to the pivoting arbour.

* * * * *